US006651751B2

(12) United States Patent
Kluczynski

(10) Patent No.: US 6,651,751 B2
(45) Date of Patent: Nov. 25, 2003

(54) DEVICE FOR ATTACHING FIRE EXTINGUISHER TO A WELDING TANK

(76) Inventor: Michael W. Kluczynski, 1230 Beethoven Common #304, Fremont, CA (US) 94538

( * ) Notice: Subject to any disclaimer, the term of this patent is extended or adjusted under 35 U.S.C. 154(b) by 0 days.

(21) Appl. No.: 09/765,831

(22) Filed: Jan. 19, 2001

(65) Prior Publication Data

US 2002/0096576 A1 Jul. 25, 2002

(51) Int. Cl.[7] ..... A62C 29/00

(52) U.S. Cl. ..... 169/51; 169/30; 169/52; 169/54; 169/66; 169/68; 248/505

(58) Field of Search ..... 169/51, 30, 52, 169/54, 68, 66; 248/505, 154, 316.7, 313, 312

(56) References Cited

U.S. PATENT DOCUMENTS 3,310,270 A * 3/1967 Ciancio ..... 248/210
3,709,545 A * 1/1973 Oltsmanns ..... 294/31.2
3,896,881 A * 7/1975 De Boer ..... 169/66
4,345,789 A * 8/1982 Garnett ..... 294/31.2
4,949,889 A * 8/1990 Carson ..... 128/205.22
5,100,007 A * 3/1992 Espasandin et al. ..... 211/85.18
5,577,698 A * 11/1996 Liu et al. ..... 24/16 PB
5,579,967 A * 12/1996 Berg ..... 224/250
5,793,280 A * 8/1998 Hincher ..... 340/326
6,311,779 B2 * 11/2001 McSheffrey et al. ..... 169/23
6,367,753 B1 * 4/2002 Berg ..... 248/222.11
2001/0030271 A1 * 10/2001 Weesner et al. ..... 248/316.7

* cited by examiner

*Primary Examiner*—Robin O. Evans
(74) *Attorney, Agent, or Firm*—Dorsey & Whitney LLP

(57) ABSTRACT

A device for securing a fire extinguisher to a welding tank is disclosed. In the preferred embodiment, an adjustable retaining strap is connected to a fire extinguisher hanger having opposing flanged members that define a receiving area for the neck of a fire extinguisher. Each flanged member has sections of stepped thickness to provide a press fit for the neck of the fire extinguisher into the receiving area. A utility hook is also attached to the retaining band for hanging hoses, welding masks and respirators. A utility box is also attached to the retaining band to provide storage for smaller objects such as welding tips. Alternative embodiments provide a retaining clip for receiving and retaining the fire extinguisher and a retaining clamp for receiving the welding tank. Other alternative embodiments provide a collar and hanging assembly for attaching the fire extinguisher hanger to the welding tank. A securing strap is also disclosed for securing collared embodiments to the welding tank.

20 Claims, 6 Drawing Sheets

DEVICE FOR ATTACHING FIRE EXTINGUISHER TO A WELDING TANK

FIELD OF THE INVENTION

The present invention relates broadly to welding and fire safety; specifically, the present invention relates to a device for attaching a fire extinguisher to a welding tank.

BACKGROUND OF THE INVENTION

Fire safety is of paramount concern to the welding industry. A welder uses a torch and tank system to apply an open flame to a solid material. The material is heated to a temperature that is high enough to melt the material to form a weld that strengthens a single piece of material or form a bond between two or more separate pieces. It is not always possible to weld in an environment completely devoid of flammable materials. For instance, in an automobile body repair shop, welding is often performed on a vehicle while flammable materials such as plastic components, seats, carpet, etc., are located inside the vehicle. The torch is often used to cut away damaged body panels, and then weld replacement panels onto the vehicle. The heat from the flame can be conducted from the welding area to the inside of the vehicle, thus igniting the flammable materials. Stray sparks from the welding area may also ignite oil or other fluids that have leaked from the vehicle onto the floor of the shop. A welder must carefully watch the area of the welding tip and material being welded, and usually as a result his attention is diverted away from the area where a fire may start. The situation is even more difficult for on-site welding applications. At a construction site or other situation where welding is not being performed in a shop, securing flammable materials is extremely difficult. For example, stray sparks from the welding area may fall onto lumber, paper used in sheetrock materials, or other flammable materials used in most construction jobs.

Prior solutions have required an additional person to watch the area for fire while the welder works. However, this practice is costly and isn't followed in most cases. Thus, access to fire extinguishers is critical to ensure the safety of any welding operation. In a shop setting, extinguishers are often mounted at known locations throughout the shop. However, for on-site welding applications, the placement of fire extinguishers is less effective, and often a fire extinguisher is left in a truck or job box, or even misplaced. In the on-site case, locating the extinguisher in an emergency can be difficult or impossible.

The time that elapses between the beginning of a fire and its extinguishment is currently unacceptable. For a welder working alone, he first must recognize that a fire has started. He then has to shut off his torch and go to the fire extinguisher's location, in some cases searching for the extinguisher. The extinguisher must then be removed from its storage, and the welder must return to the fire and extinguish it. Meanwhile, the fire is spreading and causing damage and possibly injury. Thus there is a need to provide a fire extinguisher where the welder is working that allows reliable storage and easy access so that the retrieval time is shorter and incidence of injury and damage is significantly reduced.

SUMMARY OF THE INVENTION

The present invention provides an attachment mechanism that fastens a fire extinguisher to a welding tank, thus ensuring a fire extinguisher is stored in a known location that is close to a welder at all times that a torch is being used.

In a preferred embodiment, the present invention includes a retainer band that is placed securely around a welding tank. An extinguisher hanger is attached to the retainer band, which is shaped to receive the neck of a fire extinguisher and hold the extinguisher securely in place. Preferably, the retainer band is adjustable to accommodate welding tanks of various diameters. In the preferred embodiment, the retainer band is secured by attaching a male end to a female end, and then adjusting the tension to provide a secure fit around the welding tank. In the preferred embodiment, the extinguisher hanger incorporates a pair of opposed flanges incorporating a graduated or stepped surface, thus providing a press fit of the hanger between the shoulder of an extinguisher bottle and bottom of the nozzle assembly. In a alternative preferred embodiment, the extinguisher can be shaped to present the opposed flanges at an angle with respect to the extinguisher, such that the extinguisher is secured to the extinguisher hanger by gravity. In another alternative embodiment, the extinguisher hanger incorporates a retaining clip made of spring steel, plastic, fiberglass, or other flexible material having sufficient rigidity, that flexes to receive and retain the extinguisher adjacent to the welding tank. A quick release buckle assembly may also be used to secure the extinguisher to the hanger. Also in the preferred embodiment, a utility hook is provided with the retainer band to hold hoses cables or cords that may be used in connection with a welding operation. Also in the preferred embodiment, a utility box is provided with the retainer band that provides storage for small items used in a welding operation, such as welding tips that attach to the torch.

In an alternative embodiment of the present invention, a retaining clamp sized to receive a welding tank may be substituted for the retaining band. The opposed flange extinguishers as described above may be used with this embodiment as well as an opposing retaining clip sized to receive a fire extinguisher. Preferably, the tension of the retaining clamp receiving the welding tank is greater than the tension of the clip receiving the extinguisher, thus allowing the extinguisher to be easily removed from its retaining clip. Alternatively, an embodiment can use quick release buckles on either or both clips to ensure a secure fit to both the tank and the extinguisher.

In another alternative embodiment, the present invention incorporates an integral piece that conforms substantially in shape to the top of a welding tank, wherein the piece has a first aperture with an inner diameter larger than the diameter of a welding tank, and the smaller aperture, opposed to the first aperture, has a sufficient diameter to provide clearance for hose connections at the top of the welding tank, such that the piece may be placed over the top of a welding tank and securely seated against the neck of the welding tank. An extinguisher attachment is provided with the piece, and may utilize the extinguisher hanger, retaining clip, or other mechanism to securing a fire extinguisher.

In another alternative embodiment, the present invention incorporates a flexible frame design that includes a collar that is large enough to fit around the neck of a welding tank yet smaller than the outer diameter of the welding tank, such that the flexible frame is suspended from the neck of the welding bottle. The flexible frame provides a frame that flexes to receive a fire extinguisher and hold it securely to the welding tank.

In a fourth alternative embodiment, the present invention incorporates a holster formed from a cylindrical housing that has an inner diameter sufficient to receive a fire extinguisher and a closed end to support the fire extinguisher. The holster is secured to a welding tank by an attachment that fits over the neck of the welding tank and rests on top of the shoulder of the tank. Preferably, a retaining clamp or retaining band is provided at the bottom of the holster that fastens around the tank.

These features and many other attendant advantages of the present invention will become apparent from the following detailed description when read in consideration of the drawings, in which:

DETAILED DESCRIPTION

Figure 1:
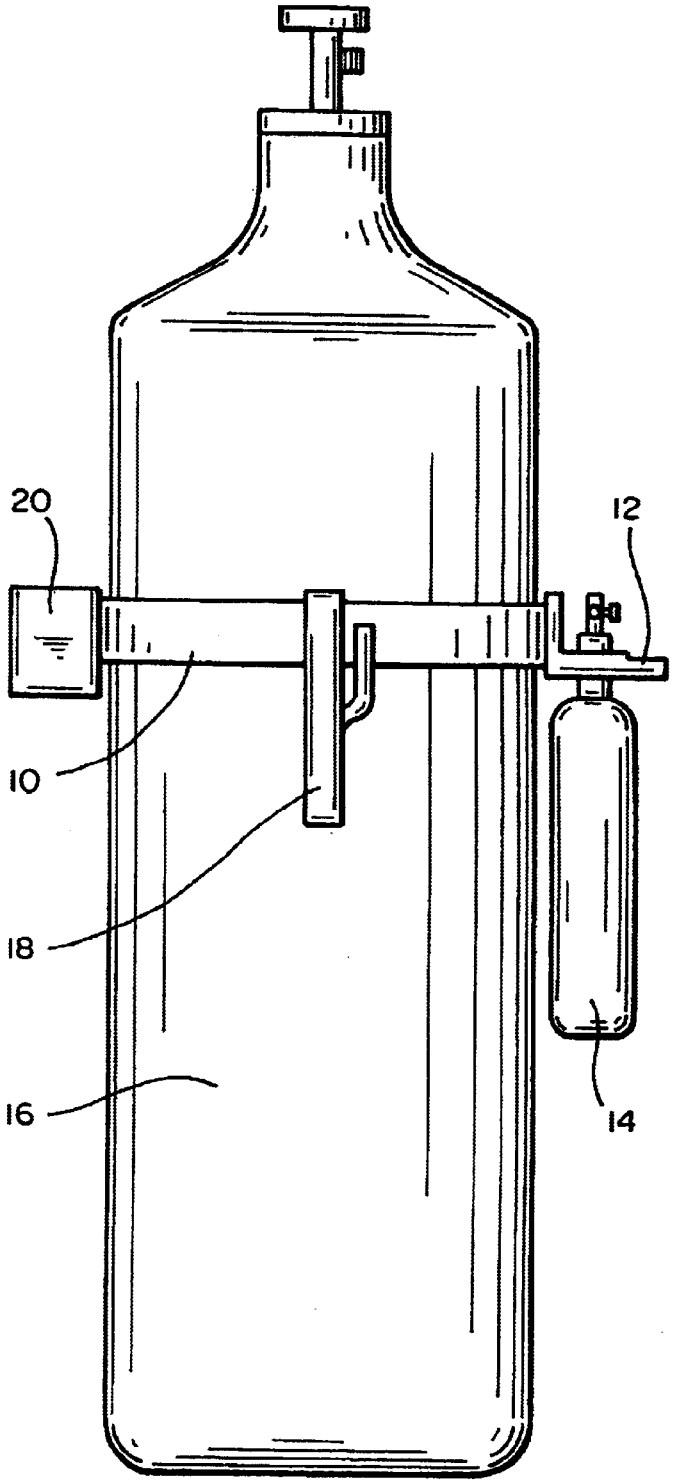
FIG. 1 is an illustration of a preferred embodiment of invention utilizing a retainer band and extinguisher hanger to attach a fire extinguisher to a welding tank.

Directing attention to FIG. 1, retainer band 10 secures flanged extinguisher hanger 12 so that fire extinguisher 14 may be supported by welding tank 16. Retainer band 10 can also be used to secure utility hook 18 and utility box 20 to the welding tank 16. Utility hook 18 can be used to hang hoses, welding masks, respirators, and other items needed in welding operation. Likewise, utility box 20 can be used to keep welding tips and other small items in a secure, organized location. Utility hook 18 and utility box 20 can be attached to retaining band 10 by fasteners, such as screws or rivets, bonding the appropriate surfaces together, forming integrated pieces, or any other suitable method.

Figure 2A:
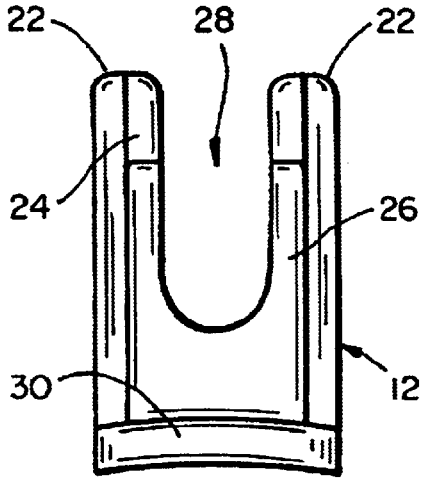
FIG. 2A is illustration providing a plan view of a flanged extinguisher hanger.
Figure 2B:
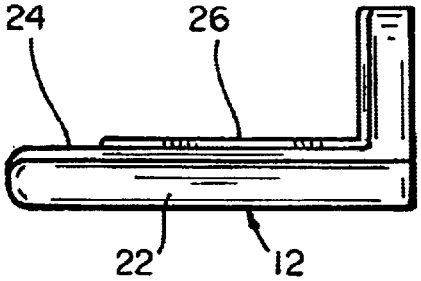
FIG. 2B is an illustration providing a profile view of the flanged extinguisher hanger.
Figure 2C:
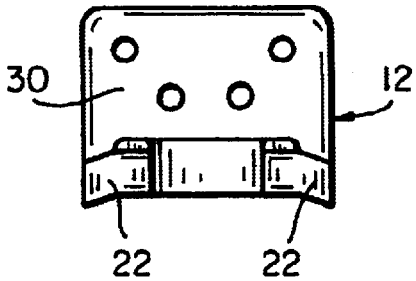
FIG. 2C is an illustration providing a front profile view of the flanged extinguisher hanger.

Directing attention to FIG. 2A, flanged extinguisher hanger 12 includes two opposing flanged members 22 having sections with stepped thicknesses. As shown in FIG. 2B, flange section 24 has a thickness that is approximately 1/32" to 1/8" less than the thickness of flange section 26, thus presenting a step as the fire extinguisher 14 is placed on the flanged fire extinguisher hanger 12. The flanged members 22 are arranged such that a receiving area 28 is defined in the center area 28 between the flanged members 22 and backing surface 30. Receiving area 28 is of sufficient dimension to receive the neck of fire extinguisher 14. Typically, five pound fire extinguishers have a neck defined by opposing flanges that define a recessed surface with a depth slightly smaller in height than the thickness of flanged section 26, thus flanged extinguisher hanger 12 provides a press fit connection that secures fire extinguisher 14 within receiving area 28. Preferably, backing surface 30 is curved at a radius that corresponds to the outer surface of welding tank 16, thus providing a snug fit when retaining band 10 is fastened around welding tank 16. As shown in FIG. 2C, flanged members 22 are angled to provide structural strength to flanged extinguisher hanger 12.

Figure 2D:
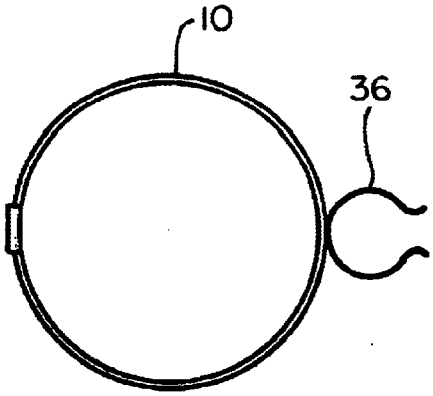
FIG. 2D is an illustration providing a plan view of an alternative embodiment of the extinguisher hanger incorporating a retaining clip.

In alternative embodiment (FIG. 2D), a retaining clip 36 may be substituted for flanged extinguisher hanger 12. Preferably, retaining clip 36 is made of spring steel or a other suitable, nonflammable material that has sufficient flexibility to distend upon receiving extinguisher 14, then retracting around extinguisher 14 to provide a snug fit.

Figure 3:
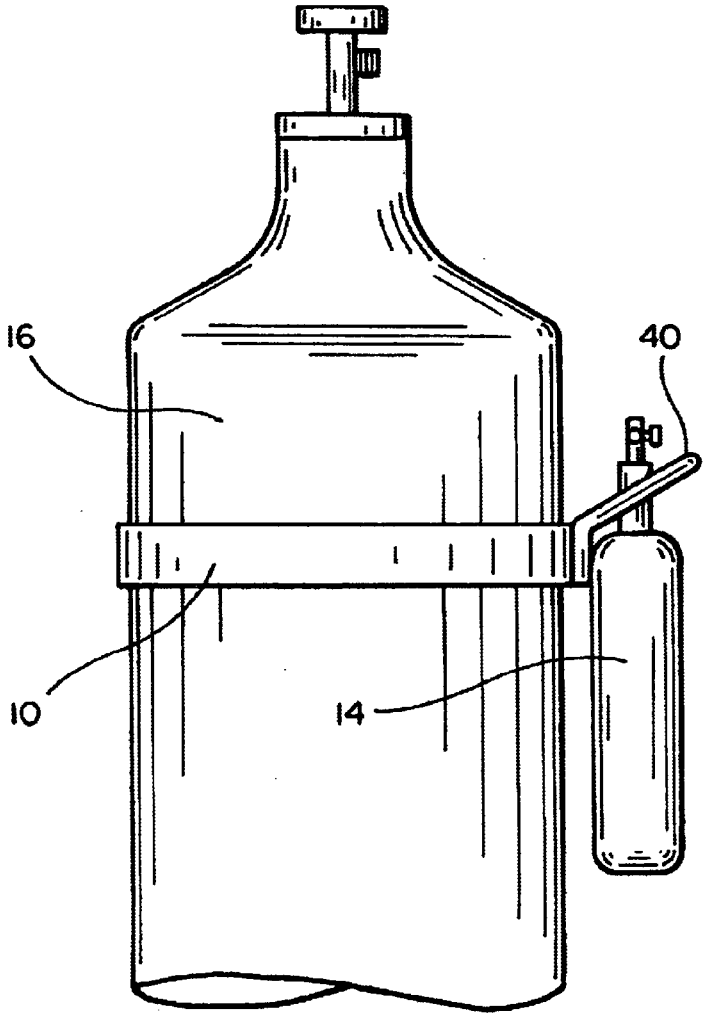
FIG. 3 is an illustration of an alternative preferred embodiment of invention utilizing the retainer band and extinguisher hanger mounted at an angle with respect to a fire extinguisher to attach the fire extinguisher to a welding tank.

In another alternative embodiment (FIG. 3), angled extinguisher hanger 40 may be utilized by bending the opposing flanges 22 to an angle of approximately 30 degrees with respect to horizontal to provide a gravity assisted support for fire extinguisher 14 within receiving area 28. In this embodiment, modifications may be made to the neck of fire extinguisher 14 to provide an angled slot that receives flanged members 22. Also in this embodiment, flanged sections 24, 26 are not required to have stepped thicknesses.

Figure 4:
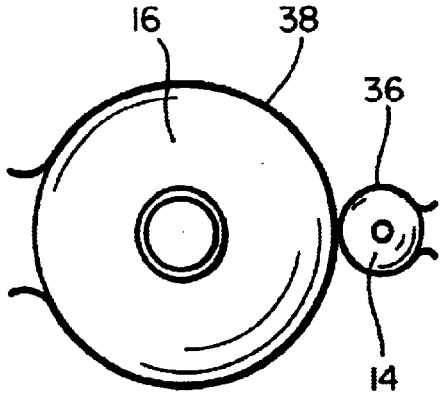
FIG. 4 is an illustration providing a plan view of an alternative embodiment that incorporates two retaining clips attached back to back.

In another alternative embodiment (FIG. 4), the retaining clip 36 can be coupled with a larger, similarly shaped retaining clamp 38. Retaining clamp 38 is an alternative to retainer band 10 and is similar in design and materials to retaining clamp 36. Preferably, retaining clamp 38 has a stronger spring characteristic to remain secured to tank 16 when extinguisher 14 is removed from retaining clamp 36.

Figure 5:
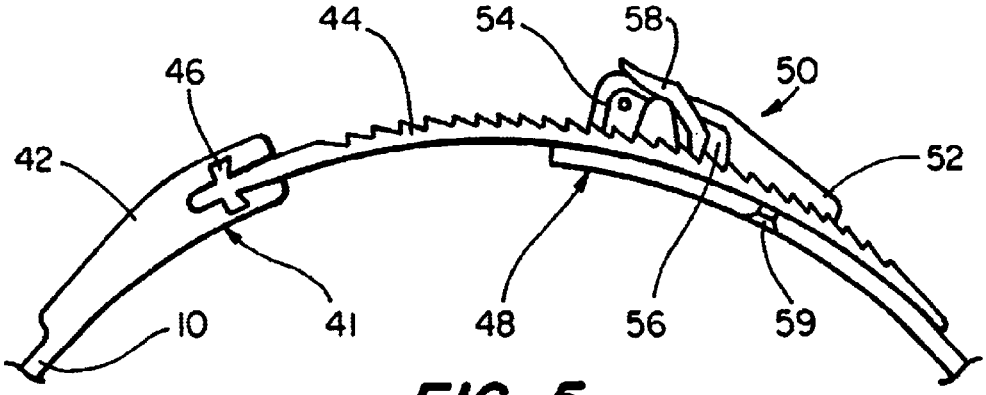
FIG. 5 is an illustration of the securing components of the retainer band that attach the retainer band to a welding tank and provide tension adjustment.

FIG. 5 illustrates the closure and adjustment mechanism utilized in the preferred embodiment of retaining band 10. At end 41, securing element 42 secures strap 44 by providing a keyway that has a profile that matches a similarly shaped key 46 located at one end of strap 44. Strap 44 has a series of teeth that allow retaining strap 10 to expand to a variety of circumferences to accommodate welding tanks of different thicknesses. End 48 provides clasp 50 that receives and retains strap 44 at a desired tension level. When strap 44 is fed through clasping element 56, spring loaded securing element 58 lifts upward to engage the teeth on strap 44, thus securing strap 22 into fastener 50. Locking lever 52 pivots on pivot anchor element 54 to assist in securing retaining band 10 around tank 12. Pivot anchor 54 is fastened to end 41 by rivet 59. To detach retaining band 10 from welding tank 12, securing element can be lifted from its secured position to release strap 44 from clasping element 56. Locking lever 52 is also released to remove retaining strap from welding tank 12.

Figure 6:
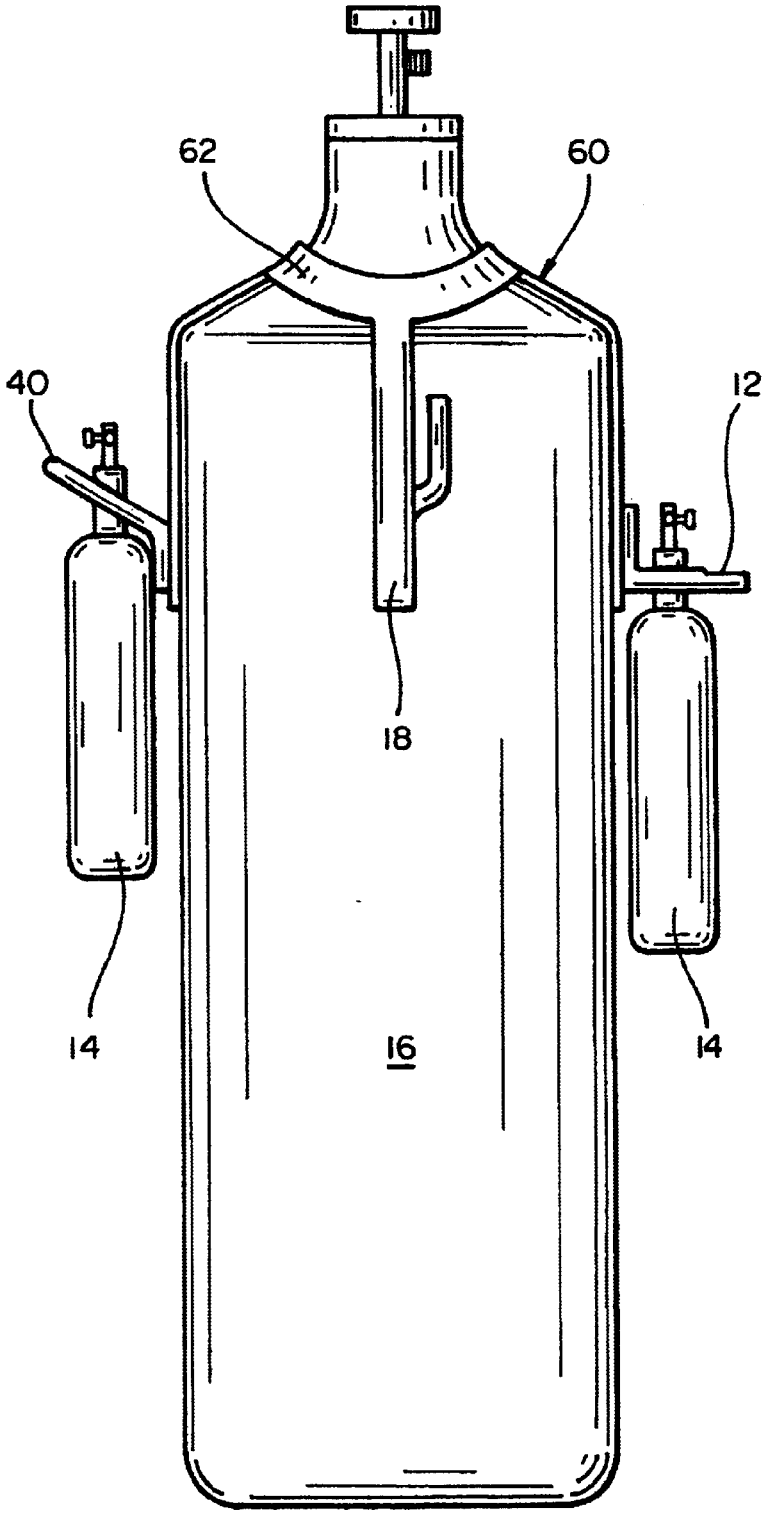
FIG. 6 is an illustration of an alternative embodiment incorporating an integral collar that fits over the neck of a welding tank.
Figure 7A:
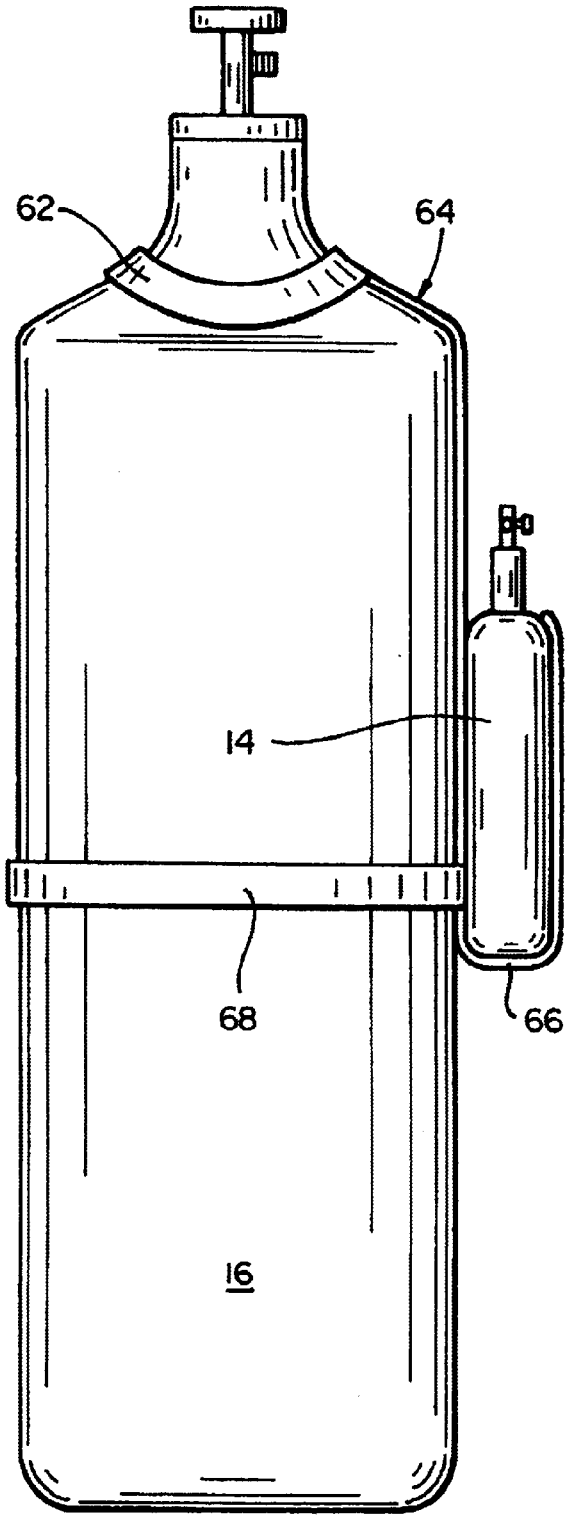
FIGS. 7A and 7B illustrate of an alternative embodiment incorporating a flexible frame basket that attaches to the neck of a welding tank.
Figure 7B:
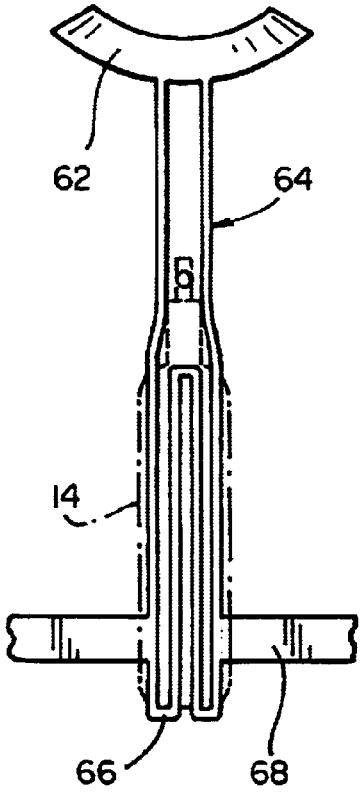
Figure 8:
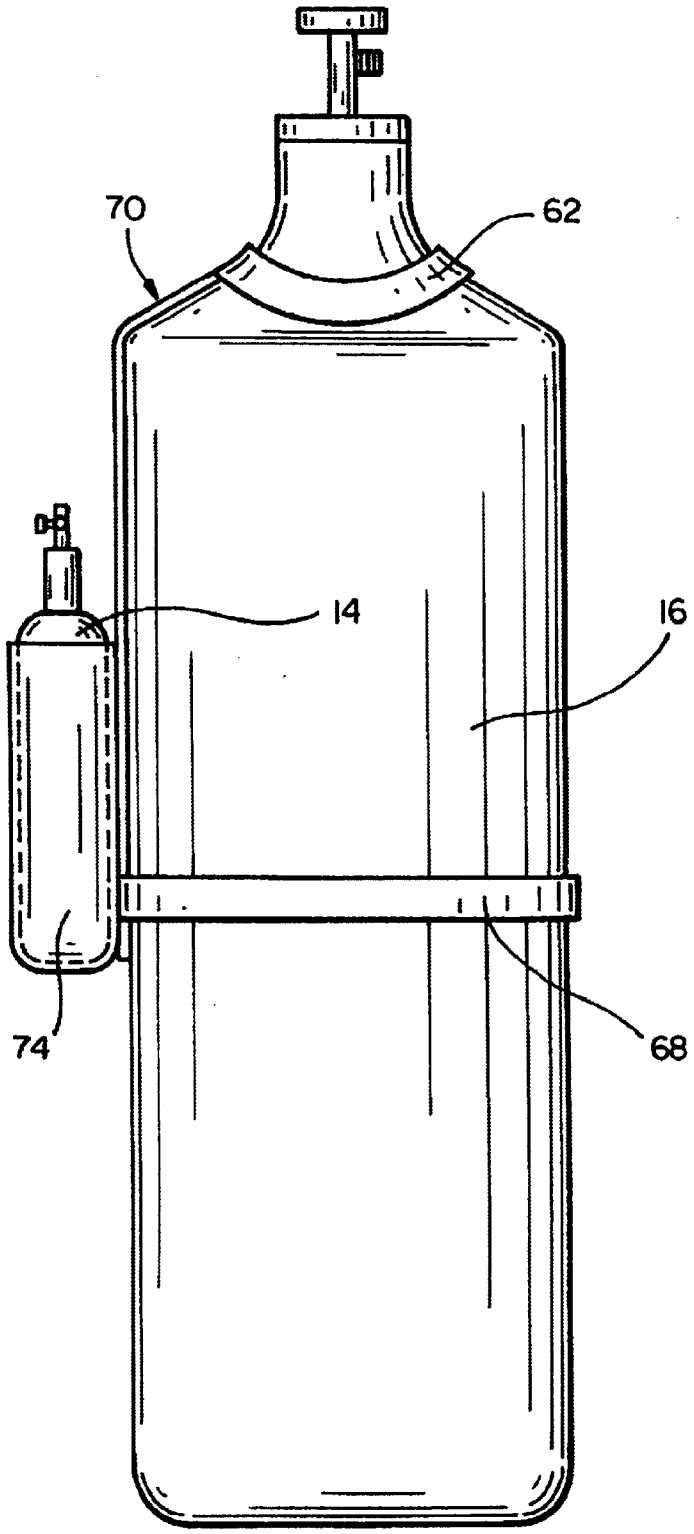
FIG. 8 is an illustration of an alternative embodiment incorporating a fire extinguisher holster that attaches to the neck of a welding tank.

FIG. 6 illustrates an alternative embodiment utilizing an integral harness 60 that fits over the shoulder of welding tank 16 and is suspended by collar 62. Harness 60 can be rigid or flexible, and can accommodate the various embodiments of fire extinguisher hangers 12, 40 as well as retaining clip 36 (not shown). Utility hook 18 can also be incorporated in harness 60, as can be utility box 20. In yet another alternative embodiment 64 (FIGS. 7A and 7B), collar 62 can be used to support a flexible frame basket that is presented at an angle and made from sufficiently flexible material, such as spring steel, to distend to upon receiving extinguisher 14 and then retract around it to provide a snug fit. Strap 68 can be placed around welding tank 16 and incorporate a similar design as retaining band 10 to provide stability to frame basket 66. In still another alternative embodiment 70, (FIG. 8), a holster 74 can be suspended by collar 62. Holster 74 can be rigid or flexible, and provides a closed end, substantially cylindrical member to receive and support extinguisher 14.

The materials used to construct the various embodiments of the present invention are preferably stainless steel, aluminum, or other suitable metal, or heat resistant materials such as leather, asbestos, fiberglass, or carbon fiber utilizing either plastic or acrylic resin. As described above, dimensions for alternative embodiments 60, 64, and 70 are suitable for supporting a fire extinguisher weighing approximately five pounds, as is typically included in safety equipment used in welding applications. The intended usage of the various embodiments of the present invention is as follows. First, the welding tank 16 is placed in a desired location. The present invention is then placed on the welding tank 16. The fire extinguisher 14 is then fastened to the welding tank 16, where it remains in a convenient location and may be readily accessed in the event of a fire.

Having described and illustrated the best mode and various alternative embodiments of a device for attaching a fire extinguisher to a welding tank, various modifications may be made to the disclosed embodiments while remaining within the scope of the present invention as defined by the following claims.

What is claimed is:

1. The combination of a welding tank, a retaining band encircling and secured to the welding tank;

a fire extinguisher hanger fastened to said retaining band, and a fire extinguisher having a neck engaging said hanger whereby it is supported by and adjacent to the welding tank.

2. The device of claim 1, wherein said retaining band comprises first and second ends, a strap having first and second ends, and a clasp, said first end of said band connected to said first end of said strap, said clasp receiving said second end of said strap for securing said band to a welding tank.

3. The device of claim 1, wherein said fire extinguisher hanger comprises two opposing flanged members, said flanged members presenting a receiving area for the neck of said fire extinguisher.

4. The device of claim 1, wherein said fire extinguisher hanger comprises a retaining clip, said retaining clip haying sufficient elasticity to distend to receive said fire extinguisher and retract to retain said fire extinguisher.

5. The device of claim 1, wherein said retaining band comprises a retaining clip, said retaining clip having sufficient elasticity to distend to receive said welding tank and retract to retain said welding tank.

6. The device of claim 1, further including a utility hook attached to said retaining band.

7. A device for attaching a fire extinguisher to a welding tank, comprising a retaining band adapted to encircle and be secured to the welding tank;

a fire extinguisher hanger fastened to said retaining band, said fire extinguisher hanger adapted to engage the neck of a fire extinguisher; and a utility box attached to said retaining band.

8. The device of claim 2, wherein said strap includes a plurality of teeth, said plurality of teeth providing a gripping surface for adjusting the area enclosed by said retaining band.

9. The device of claim 3, wherein said fire extinguisher has a neck having a height defined by two opposing surfaces, wherein said flanged members of said extinguisher hanger have first opposed sections and second opposed sections, said second opposed sections having a thickness equal to at least the neck of said fire extinguisher, such that placing said fire extinguisher in said receiving area brings said second opposed sections into contact with said opposing surfaces defining said neck.

10. The device of claim 3, wherein said fire extinguisher has a neck having a height defined by two opposing surfaces, wherein said neck has an outer diameter of at most the width of said receiving area, wherein said flanged members of said fire extinguisher hanger are presented at an angle with respect horizontal such that one of said opposing surfaces defining said neck is brought into contact with said flanged members such that gravity retains said fire extinguisher within said receiving area.

11. In combination a welding apparatus of the type having a welding tank, a fire extinguisher and a device for removably mounting said fire extinguisher to the welding tank, said device comprising:

a retaining band adapted to encircle and be secured to said welding tank, and a fire extinguisher hanger fastened to said retaining band, said fire extinguisher hanger comprising two opposing spaced members for engaging the neck of the fire extinguisher.

12. A device for securing a fire extinguisher hanger to a welding tank having a neck of a diameter smaller than the tank diameter comprising a fire extinguisher hanger; and a suspension member connected to said fire extinguisher hanger; and a collar connected to suspension member, said collar having an inner diameter larger than the neck diameter and smaller than the tank diameter.

13. The device of claim 12, wherein said fire extinguisher hanger comprises two opposing flanged members, said flanged members presenting a receiving area for said fire extinguisher.

14. The device of claim 12, wherein said fire extinguisher hanger comprises a retaining clip, said retaining clip having sufficient elasticity to distend to receive said fire extinguisher and retract to retain said fire extinguisher.

15. The device of claim 12, wherein said fire extinguisher has a neck having a height defined by two opposing su faces, wherein said flanged members of said extinguisher hanger have first opposed sections d second opposed sections, said second opposed sections having a thickness equal to at least he neck of said fire extinguisher, such that placing said fire extinguisher in said receiving area rings said second opposed sections into contact with said opposing surfaces defining said neck.

16. The device of claim 12, wherein said fire extinguisher has a neck having a height defined by two opposing surfaces, wherein said neck has an outer diameter of at most the width of said receiving area, wherein said flanged members of said fire extinguisher hanger are presented at an angle with respect to horizontal such that one of said opposing surfaces defining said neck is brought into contact with said flanged members such that gravity retains said fire extinguisher within said receiving area.

17. The device of claim 12, wherein said fire extinguisher hanger comprises a retaining clip, said retaining clip haying sufficient elasticity to distend to receive said fire extinguisher and retract to retain said fire extinguisher.

18. The device of claim 12, wherein said fire extinguisher hanger comprises a frame basket.

19. The device of claim 12, wherein said fire extinguisher hanger comprises a holster.

20. The device of claim 12, wherein a securing strap is attached to said fire extinguisher hanger to secure said fire extinguisher hanger to said welding tank.

* * * * *